US009119424B2

(12) United States Patent
Kakuno et al.

(10) Patent No.: US 9,119,424 B2
(45) Date of Patent: Sep. 1, 2015

(54) BOTTOM CLOTHES

(75) Inventors: Maki Kakuno, Kyoto (JP); Junko Kumai, Kyoto (JP)

(73) Assignee: Wacoal Corp., Kyoto (JP)

( * ) Notice: Subject to any disclaimer, the term of this patent is extended or adjusted under 35 U.S.C. 154(b) by 0 days.

(21) Appl. No.: 13/876,555

(22) PCT Filed: Sep. 16, 2011

(86) PCT No.: PCT/JP2011/071280

§ 371 (c)(1),
(2), (4) Date: Apr. 29, 2013

(87) PCT Pub. No.: WO2012/043285

PCT Pub. Date: Apr. 5, 2012

(65) Prior Publication Data

US 2013/0210318 A1 Aug. 15, 2013

(30) Foreign Application Priority Data

Sep. 29, 2010 (JP) ..... P2010-219050

(51) Int. Cl.
*A41C 1/00* (2006.01)
*A41C 1/02* (2006.01)

(52) U.S. Cl.
CPC .... *A41C 1/00* (2013.01); *A41C 1/02* (2013.01)

(58) Field of Classification Search
CPC ..... A41D 2300/22; A41C 1/00; A41C 1/03; A41B 9/00; A41B 9/08; A41B 2300/22; A41B 9/002
USPC ..... 450/122–124, 130, 131, 151; 2/69, 228, 2/227, 238; 272/119; 472/119
See application file for complete search history.

(56) References Cited

U.S. PATENT DOCUMENTS 3,523,540 A * 8/1970 Morehouse ..... 450/115
3,524,449 A * 8/1970 Peters ..... 450/100
3,894,542 A * 7/1975 Sacristan ..... 450/123
4,576,154 A * 3/1986 Hyman et al. ..... 602/19

(Continued)

FOREIGN PATENT DOCUMENTS

CN 1461190 A 12/2003
JP 3010476 2/1995

(Continued)

OTHER PUBLICATIONS

Office Action, Japanese Application No. P2010-219050, dated Oct. 1, 2013.

(Continued)

*Primary Examiner* — Gloria Hale
(74) *Attorney, Agent, or Firm* — Leydig, Voit & Mayer

(57) ABSTRACT

The bottom clothes have: a main body part 10 that covers at least each buttocks part; and a band-like first tightening part 20, 20 and a band-like second tightening part 30, 30 both of which are disposed in pairs on left and right sides of the main body part 10 and have tightening forces stronger than that of the main body part 10, wherein the first tightening part 20, 20 is disposed on a rear center side from a top D of the buttocks part and extends vertically from a main body upper part E to a gluteal fold F, and the second tightening part 30, 30 is disposed below the top D of the buttocks part, covers at least an upper section of the gluteal fold F and extends upward from a lower end part of the first tightening part 20, 20 upward to a side.

13 Claims, 19 Drawing Sheets

(56) References Cited

U.S. PATENT DOCUMENTS

| | | | | |
|---|---|---|---|---|
| 5,390,512 | A * | 2/1995 | Mista | 66/205 |
| 5,640,714 | A * | 6/1997 | Tanaka | 2/22 |
| 6,080,125 | A * | 6/2000 | Mott | 602/61 |
| 6,186,970 | B1 * | 2/2001 | Fujii et al. | 602/75 |
| 7,074,204 | B2 * | 7/2006 | Fujii et al. | 602/75 |
| 7,559,093 | B2 * | 7/2009 | Sudo et al. | 2/69 |
| 2003/0028952 | A1 * | 2/2003 | Fujii et al. | 2/400 |
| 2008/0194181 | A1 * | 8/2008 | Sudo et al. | 450/123 |
| 2012/0210318 | A1 * | 8/2012 | Sanghvi et al. | 718/1 |

FOREIGN PATENT DOCUMENTS

| | | | |
|---|---|---|---|
| JP | H07-018041 | B2 | 3/1995 |
| JP | H07-316902 | A | 12/1995 |
| JP | 08-127903 | | 5/1996 |
| JP | 08-158109 | | 6/1996 |
| JP | 09-059805 | | 3/1997 |
| JP | 2000-345407 | A | 12/2000 |
| JP | 2006-283265 | | 10/2006 |
| JP | 2007-077566 | | 3/2007 |
| JP | 2010-084305 | A | 4/2010 |
| WO | WO 2004/093576 | A1 | 11/2004 |

OTHER PUBLICATIONS

Notification of Information Provision, Japanese Application No 2010-219050, dated Sep. 17, 2013.

International Search Report, Application No. PCT/JP2011/071280, mailed Nov. 15, 2011.

Office Action, Chinese Patent Application No. 201180047433.7, dated Mar. 4, 2014.

International Preliminary Report on Patentability, Application No. PCT/JP2011/071280, mailed Apr. 11, 2013.

* cited by examiner (a)

(b)

(a)

(b)

(a)

(b)

(a)

(b)

BOTTOM CLOTHES

TECHNICAL FIELD

The present invention relates to bottom clothes with buttocks shaping functions.

BACKGROUND ART

Patent Literatures 1 to 3 each disclose a girdle as bottom clothes having buttocks shaping functions. The girdles disclosed in Patent Literatures 1 and 2 each have elastic band-like tightening parts for lifting the hip of a wearer and improving the shape of the hip to make it look pretty. Each of the tightening parts extends obliquely upward from the crotch part to the side along each gluteal fold and further extends upward at the side of the buttocks.

However, in these types of girdles with the tightening parts, the tightening parts apply pressure across the parts near substantially the center of the belly pieces of the gluteus maximus muscles, interfering with leg movement and lowering the wear comfort (see Patent Literature 3).

The girdle disclosed in Patent Literature 3, on the other hand, is provided with band-like tightening parts that allow easy leg movement even during exercise, provide excellent wear comfort, and realize the hip lift up function. The tightening parts extend along the vicinity of edges of the left and right gluteus maximus muscles, which are closer to a rear middle line than a top part of the hip. An upper end of each tightening part extends obliquely upward beyond a hip line toward the side to reach the side of the waistline, while a lower end of each tightening part extends obliquely downward toward the side to reach the vicinity of the lowest point of each gluteal fold.

CITATION LIST

Patent Literature

Patent Literature 1: Japanese Utility Model Registration No. 3010476

Patent Literature 2: Japanese Patent Application Publication No. H8-127903

Patent Literature 3: Japanese Patent Application Publication No. 1-18-158109

SUMMARY OF INVENTION

Technical Problem

Incidentally, FIG. 1 shows an ideal round buttocks shape in which the left and right buttocks form two mountains.

Young people in their late teens and twenties tend to have laterally protruding buttocks and wish to shape such laterally protruding buttocks into small buttocks. The girdles disclosed in Patent Literatures 1 and 2 are considered effective for this type of young people.

On the other hand, elderly people over 50 have the following tendencies, as shown in FIG. 2:

(1) Buttocks sagging inward (downward and toward the rear center) (region A); and (2) Sunken flesh in the vicinity of the back of each greater trochanter (region B).

Therefore, the entire buttocks form a square shape, and mountain shapes of left and right buttocks are distorted.

When the girdles disclosed in Patent Literatures 1 and 2 are put on this type of elderly people, the fleshes that sags inward can be somewhat lifted up to the sides, but the entire buttocks are shaped into a single mountain, and the square buttocks shape cannot be rounded. Also, the sunken flesh in the vicinity of the back of each greater trochanter cannot be improved.

When the girdle disclosed in Patent Literature 3 is put on this type of elderly people, the flesh that sags inward can be somewhat lifted upward, and the left and right buttocks can form two mountains to some extent. However, the square buttocks shape cannot be rounded. Also, the sunken flesh in the vicinity of the back of each greater trochanter cannot be improved.

The present invention was contrived in view of the problems described above, and an object thereof is to provide bottom clothes that can enhance buttocks shaping functions for a relatively elderly person.

Solution to Problem

Bottom clothes according to the present invention have: a main body part that covers at least each buttocks part; and first band-like tightening parts and second band-like tightening parts both of which are disposed in pairs on left and right sides of the main body part and have tightening forces stronger than that of the main body part, wherein each of the first tightening parts is disposed on a rear center side from a top of the buttocks part and extends vertically from a main body upper part to a gluteal fold, and each of the second tightening parts is disposed below the top of the buttocks part, covers at least an upper section of the gluteal fold and extends upward from a lower end part of the first tightening part upward to a side.

According to the bottom clothes, the first tightening part functions to lift up inward sagging flesh of the buttocks part that occurs in an elderly person in particular. The second tightening part functions to lift up the entire lower part of the buttocks part, particularly the inward sagging flesh of the buttocks part that occurs in an elderly person in particular, toward each side, and functions to move the flesh near the gluteal cleft, which is lifted up by the first tightening part, toward the top of the buttocks part. The upward lifting force of the first tightening part and the lifting force of the second tightening part for lifting the flesh upward to the side can form two, left and right, mountains, to round the entire buttocks part.

Furthermore, according to the bottom clothes, the combination of the upward lifting force of the first tightening part and the lifting force of the second tightening part for lifting the flesh upward to the side functions to move the flesh of the buttocks part to the back of each greater trochanter. Therefore, the flesh on the back of the greater trochanter can be prevented from being sunken, as is unique to elderly people. As a result, the entire buttocks part can be rounded.

It is preferred that the second tightening part be disposed below the top of the buttocks part and cover at least the gluteal fold. Accordingly, the lifting force of the second tightening part for lifting the flesh upward to the side can be enhanced.

It is preferred that a maximum width of the second tightening part be greater than a maximum width of the first tightening part. This aspect can enhance the lifting force of the second tightening part, which functions to move the flesh near the gluteal cleft, lifted by the first tightening part, toward the top of the buttocks part and to the sides. Thus, the lifting force for lifting the flesh upward to the side can efficiently be utilized.

It is preferred that a lowermost point on a lower hem of the second tightening part be located close to a rear center from a lowermost point on an upper hem of the second tightening part. Accordingly, the upward lifting force of the second tightening part can be enhanced, and the lifting force for lifting the flesh upward to the side can efficiently be enhanced.

It is preferred that the second tightening part extend to and cover a lower section of the gluteal fold. In an elderly person over 50, a plurality of masses of flesh bulge in the femurs under the gluteal folds, as shown in FIG. 2. The second tightening part that covers the section including the lower section of the gluteal fold can efficiently exert the lifting force for lifting the flesh upward to the side, and smoothen and reduce the plurality of masses of bulging flesh located in the femur under the gluteal fold.

It is preferred that the first tightening part extend from a rear center in the vicinity of a waist, which is the main body upper part. Accordingly, the upward lifting force of the first tightening part for lifting the flesh upward can efficiently be utilized.

Advantageous Effects of Invention

The present invention can improve its buttocks shaping functions for a relatively elderly person.

DESCRIPTION OF EMBODIMENTS

Figure 1:
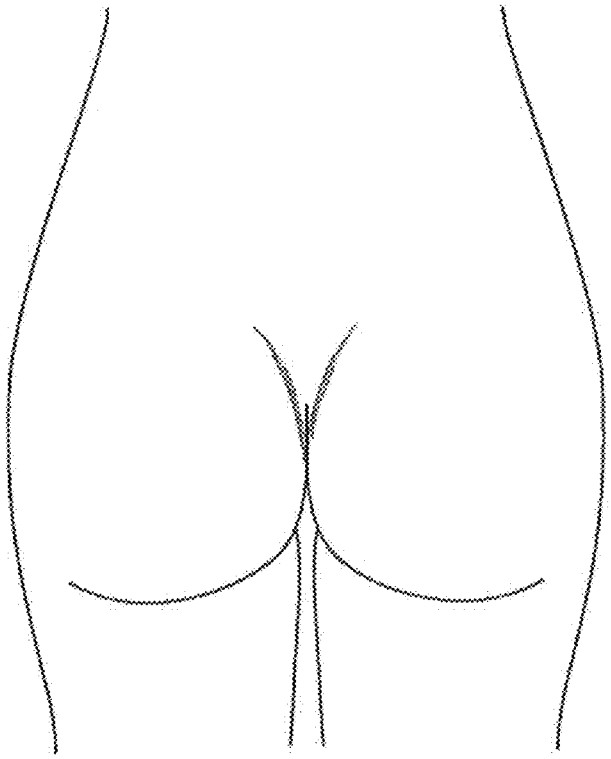
FIG. 1 is a diagram showing ideal buttocks.

Preferred embodiments of the bottom clothes of the present invention are described hereinafter in detail with reference to the drawings. Like reference characters are used to indicate the same or like portions in each of the drawings.

Figure 3:
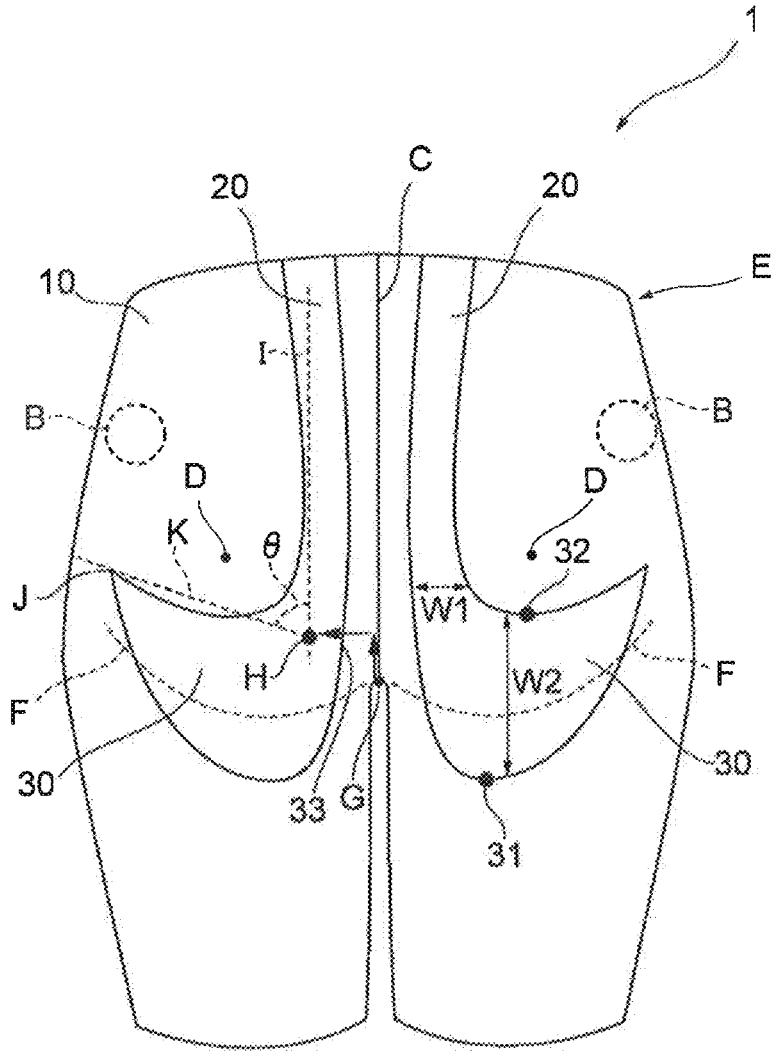
FIG. 3 is a diagram showing the back of a girdle according to an embodiment of the present invention.
Figure 4:
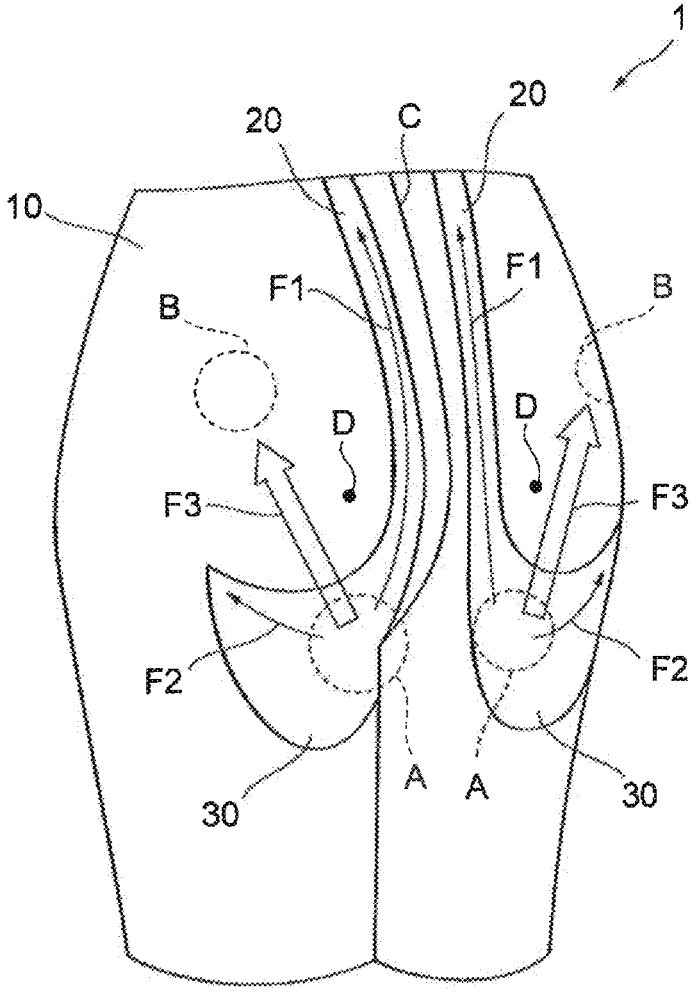
FIG. 4 is a diagram showing actions of the girdle according to the present embodiment shown in FIG. 3.

FIG. 3 is a diagram showing the back of a girdle (the inside of the girdle that comes into contact with skin of a wearer) according to an embodiment of the present invention. A girdle 1 of the present embodiment is of a long type, covering a buttocks part and the femurs of a wearer, and has a main body part 10, a pair of first tightening parts 20, 20, and a pair of second tightening parts 30, 30.

The main body part 10 covers the buttocks part and the femurs of the wearer and has adhesion to the buttocks part and the femurs. For example, elastic two-way raschel (63% nylon, 14% polyurethane, 23% cotton, 70 denier) is used as the main body part 10. The back of the main body 10 is partially provided with the first tightening parts 20, and the second tightening parts 30, 30.

Each of the first tightening parts 20, 20 and each of the second tightening parts 30, 30 are disposed in pairs on the left-hand side and right-hand side of the main body part 10 and separated without covering a gluteal cleft C. The first tightening part 20, 20 and the second tightening part 30, 30 have tightening force stronger than that of the main body part 10. For example, powernet fabrics (81.5% nylon, 18.5% polyurethane, 280 denier) having extension recoverability greater than that of the main body part 10 are used as the first tightening part 20, 20 and the second tightening part 30, 30. The first tightening part 20, 20 and the second tightening part 30, 30 have widths, and rim parts thereof are stitched to the back to the main body part 10.

In a state in which the wearer wears the girdle, the first tightening part 20, 20 is located close to a rear center (i.e., the gluteal cleft C) from a top D of each buttock and extends vertically. The first tightening part 20, 20 extends from near a rear center of a main body upper part E to a gluteal fold F. Either one of end parts of the second tightening parts 30, 30 is coupled to a lower end part of the first tightening part 20, 20.

In the state in which the wearer wears the girdle, the second tightening part 30, 30 is located below the top D of each buttock and covers a lower part of the buttock and each femur below the gluteal fold F. The second tightening part 30, 30 extends upward from the lower end part of the first tightening part 20, 20 toward a side (i.e., a flank side) substantially along the gluteal fold F. Another end part of the second tightening part 30, 30 extends below a rear side B of a greater trochanter so as to gradually become narrow. A rising angle θ of the second tightening part 30, 30 is preferably 50 degrees or more to 90 degrees or less when placed flatly, or more preferably 50 degrees or more to 80 degrees or less, with respect to the gluteal cleft, and is set at 68 degrees in the present embodiment.

In other words, the rising angle θ of the second tightening part 30, 30 is an angle formed by a line I, which is substantially parallel to the gluteal cleft C at a starting point H, and a line K connecting the starting point H and a side end J of the second tightening part 30, 30, the starting point H being located at a position approximately 40 to 50 mm above a lowermost point (crotch point) G of the center of a crotch part and approximately 40 to 50 mm to the side.

The second tightening part 30, 30 is also formed in the shape of an arc along the gluteal fold F such that a lowermost point 31 of a lower hem of the second tightening part 30, 30 is located close to the rear center from a lowermost point 32 of an upper hem of the second tightening part 30, 30. A maximum width W2 of the second tightening part 30, 30 is greater than a maximum width W1 of the first tightening part 20, 20. For example, the width of the second tightening part 30, is 50 mm to 120 mm. The width of the first tightening part 20, 20 is 20 mm to 40 mm.

The second tightening part 30, 30 and the first tightening part 20, 20 are formed such that the starting point H described above is located, near the side, at a section at least 30 mm from an end hem 33 near the rear center.

According to the girdle 1 of the present embodiment, a lifting force F1 of the first tightening part 20 functions to lift upward the flesh that sags down toward a lower inner side A of each buttock, the sagging being unique to an elderly person. Furthermore, a lifting force F2 of the second tightening part 30 functions to lift the entire lower part of the buttock, particularly the flesh sagging down toward the lower inner side A of the buttock, as is unique to an elderly person. The lifting force F2 also functions to move the flesh in the vicinity of the gluteal cleft C, which is lifted by the second tightening part 20, toward the top D of the buttock. The function of the upward lifting force F1 of the first tightening part 20, 20 and the function of the upward lifting force F2 of the second tightening part 30, 30 for lifting the flesh upward to the side can allow the formation of two mountains in the left and right buttocks and round the entire buttocks.

Moreover, according to the girdle 1 of the present embodiment, a combination force F3 of the upward lifting force F1 of the first tightening part 20 and the upward lifting force F2 of the second tightening part 30 for lifting the flesh upward to the side functions to move the flesh of each buttock toward the rear side B of the greater trochanter. Therefore, the rear side B of the greater trochanter can be prevented from being sunken, as is unique to an elderly person, and the entire buttocks can be rounded.

According to the girdle 1 of the present embodiment, because the second tightening part 30 covers the femur below the gluteal fold F as well, a plurality of masses of bulging flesh located on the femur under the gluteal fold F, which occur particularly in an elderly person, can be smoothened and thereby reduced.

Note that the present invention is not limited to the present embodiment described above, and various modifications can be made. For instance, the main body part, the first tightening parts, and the second tightening parts can be modified in various manners. Several modifications of the main body part, the first tightening parts, and the second tightening parts are described hereinafter.

[First Modification]

Figure 5:
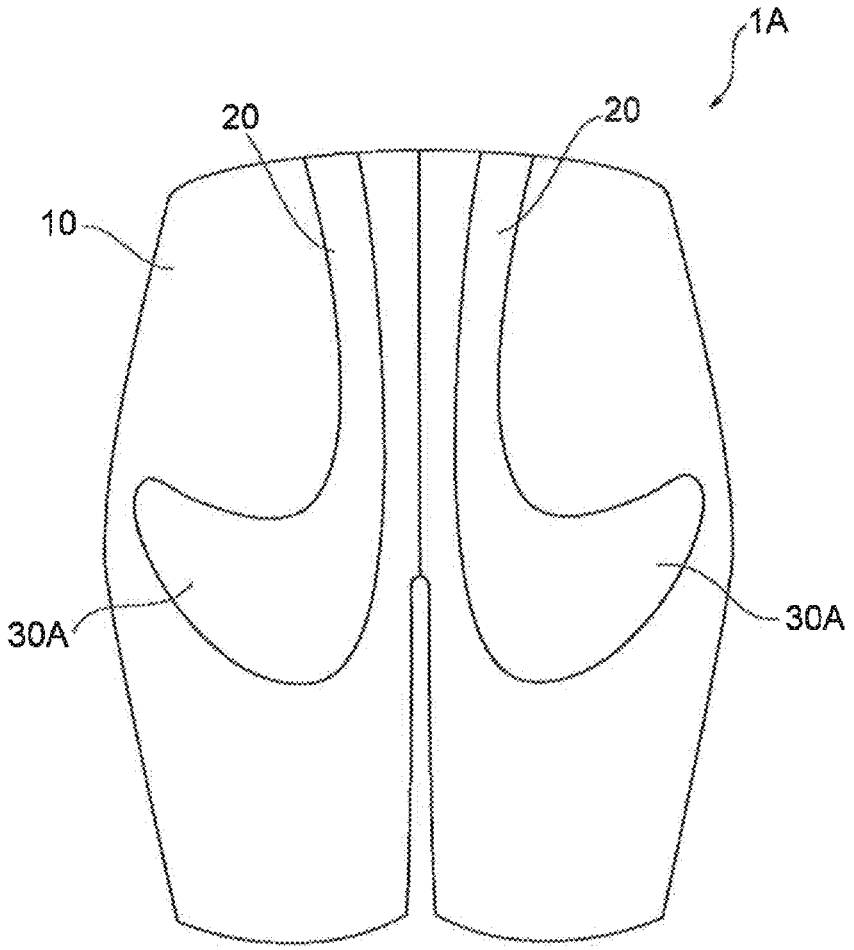
FIG. 5 is a diagram showing the back of a girdle according to a first modification of the present invention.

FIG. 5 is a diagram showing the back of a girdle according to a first modification of the present invention. The difference in configuration between this girdle 1A of the first modification and the girdle of the present embodiment is that the girdle 1A has a pair of second tightening parts 30A, 30A in place of the pair of second tightening parts 30, 30 of the girdle 1. As shown in FIG. 5, each of the second tightening parts 30A, 30A may be obtained by rounding a side end part of each of the second tightening parts 30, 30.

[Second Modification]

Figure 6:
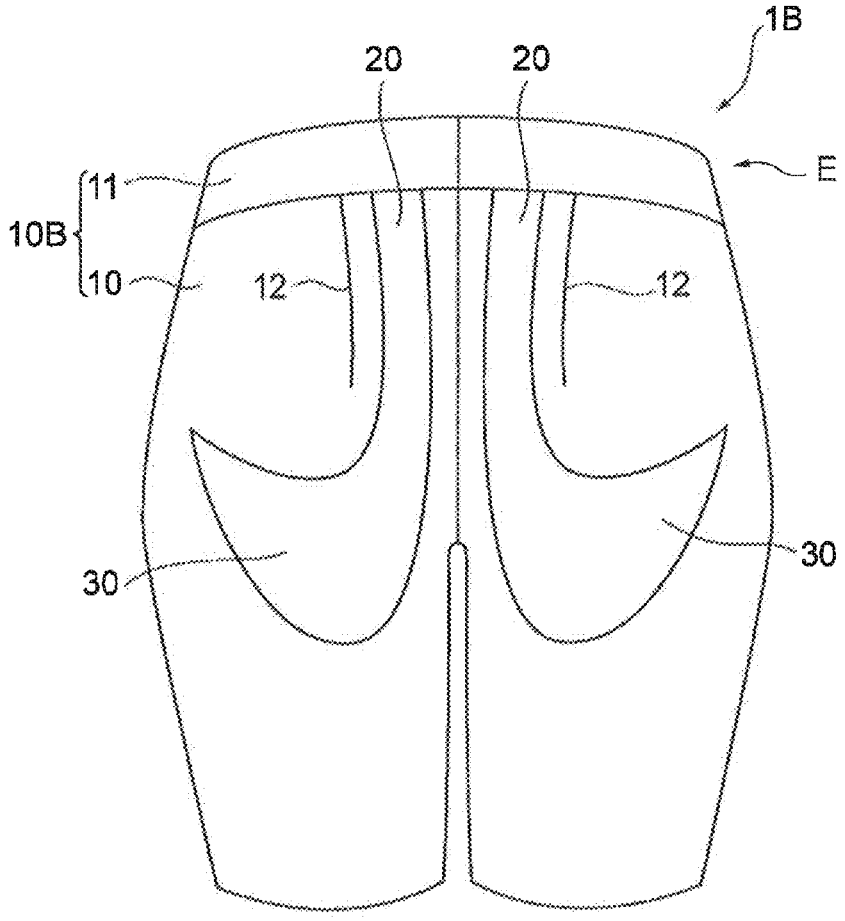
FIG. 6 is a diagram showing the back of a girdle according to a second modification of the present invention.

FIG. 6 is a diagram showing the back of a girdle according to a second modification of the present invention. The difference in configuration between this girdle 1B of the second modification and the girdle of the present embodiment is that the girdle 1B has a main body part 10B in place of the main body part 10 of the girdle 1. As shown in FIG. 6, the main body part 10B may be obtained by forming a switching part 11 on the main body upper part E of the main body part 10. For example, the switching part 11 is formed by stitching a waist rubber or other fabrics to the main body upper part E of the main body part 10. As a result, when the girdle 1B is put on the wearer, the wearer can feel an improved comfortable fit at the main body upper part E, which is a waist section. In addition, pleat parts (dart parts) 12 may be formed in the main body part 10B in order to provide leeway so that the shape of the buttocks formed by the first and second tightening parts is not collapsed.

[Third Modification]

Figure 7:
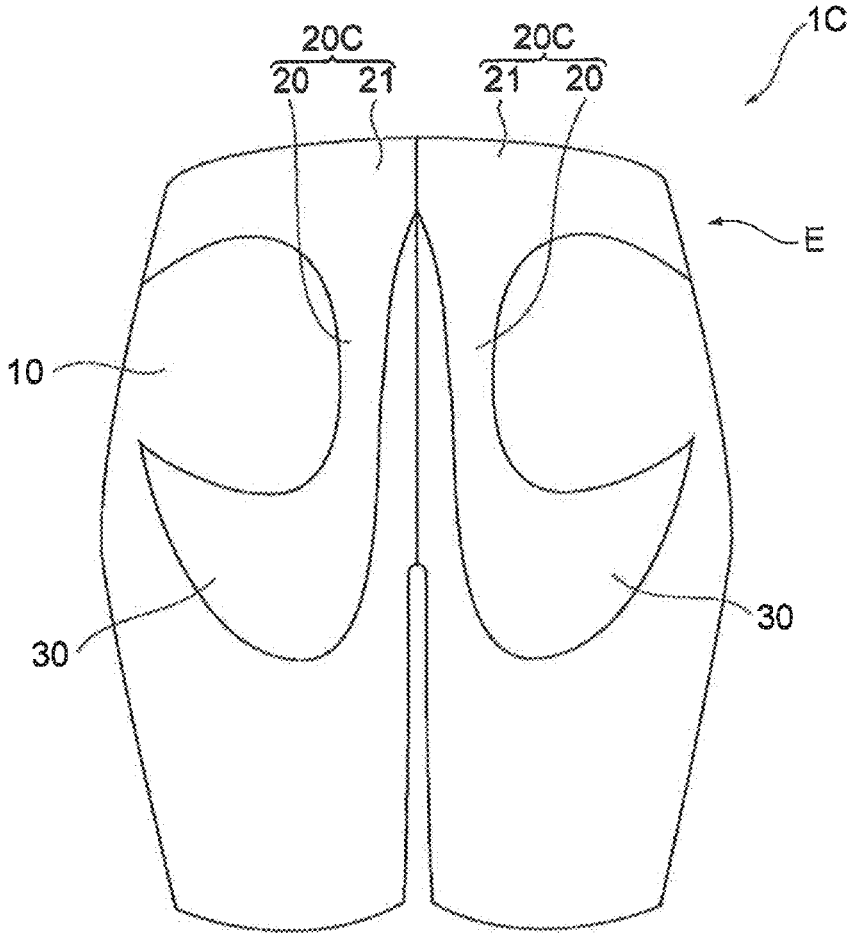
FIG. 7 is a diagram showing the back of a girdle according to a third modification of the present invention.

FIG. 7 is a diagram showing the back of a girdle according to a third modification of the present invention. The difference in configuration between this girdle 1C of the third modification and the girdle of the present embodiment is that the girdle 1C has a pair of first tightening parts 20C, 20C in place of the pair of first tightening parts 20, of the girdle 1. The first tightening parts 20C, 20C are obtained by forming switching parts 21, 21 in upper end parts of the first tightening parts 20, 20. The switching parts 21, 21 are made from the same material as the first tightening parts 20, 20 and are each stitched to the main body upper part E of the main body part 10 in such a manner as to circle half around the main body upper part E from the rear center to a front center. The switching parts 21, 21 may be separated from each other, without being stitched by circling half around the main body upper part E. The switching part 11 in the second modification may be made from the same material as the first tightening parts 20, 20.

[Fourth Modification]

Figure 8:
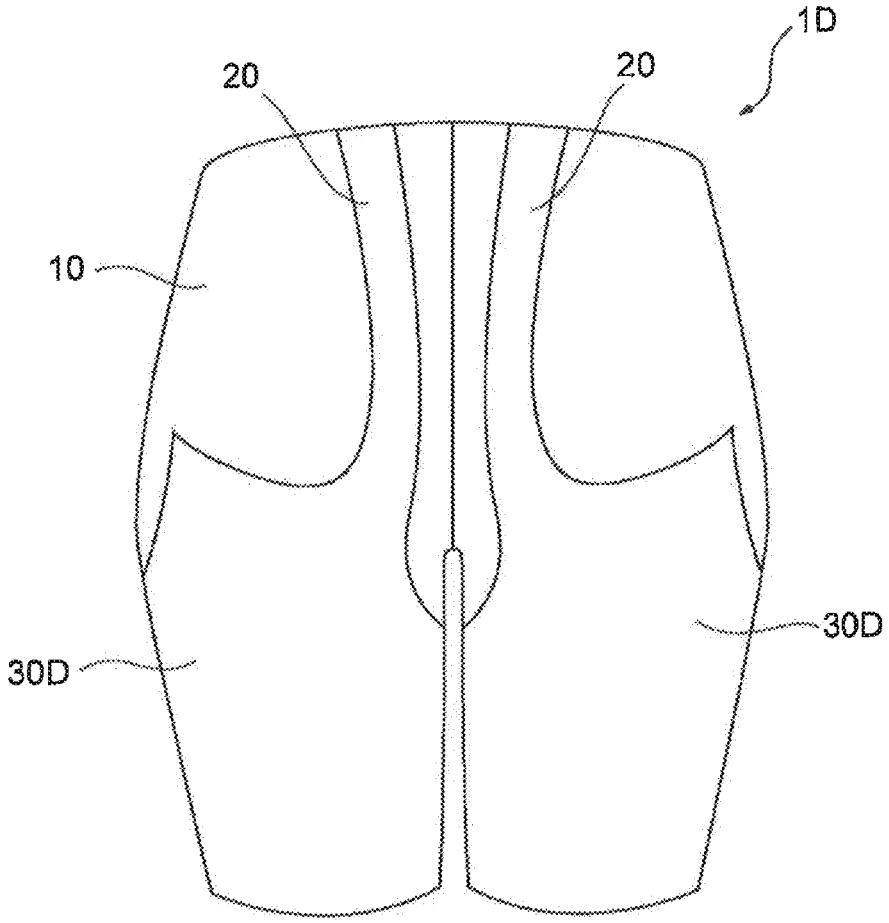
FIG. 8 is a diagram showing the back of a girdle according to a fourth modification of the present invention.

FIG. 8 is a diagram showing the back of a girdle according to a fourth modification of the present invention. The difference in configuration between this girdle 1D of the fourth modification and the girdle of the present embodiment is that the girdle 1D has a pair of second tightening parts 30D, 30D in place of the pair of second tightening parts 30, 30 of the girdle 1. As shown in FIG. 8, the second tightening parts 30D, 30D may be formed to cover the femurs in addition to the sections covered by the second tightening parts 30, 30.

[Fifth Modification]

Figure 9:
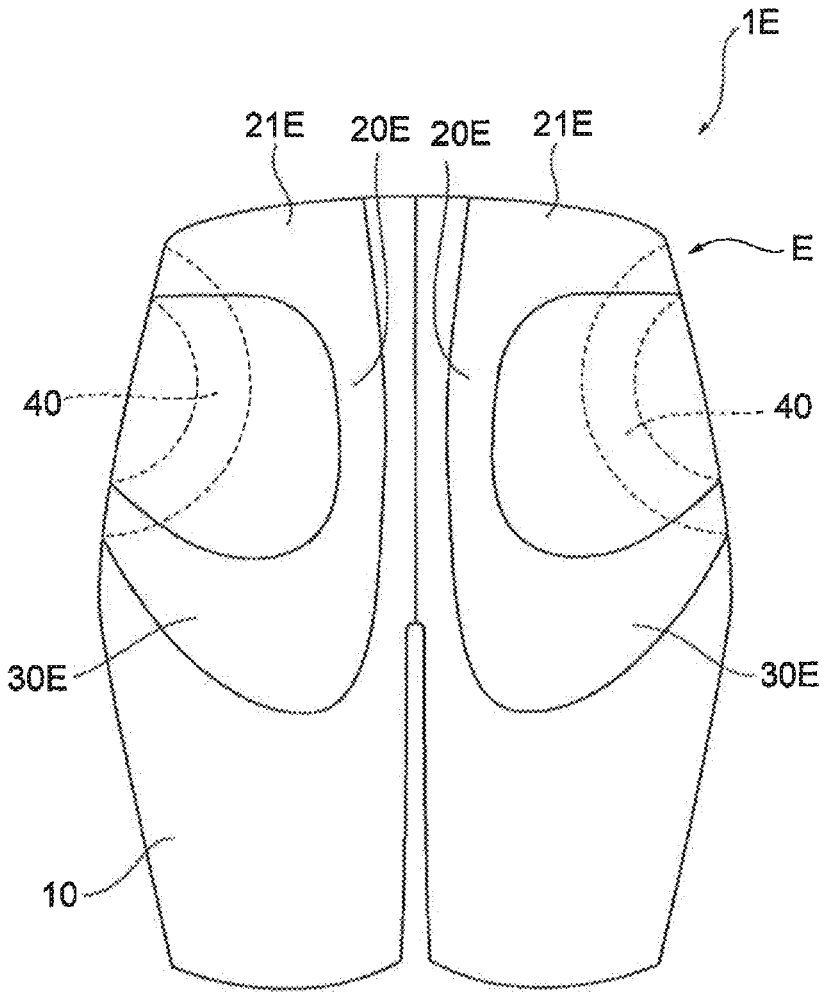
FIG. 9 is a diagram showing the back of a girdle according to a fifth modification of the present invention.

FIG. 9 is a diagram showing the back of a girdle according to a fifth modification of the present invention. The difference in configuration between this girdle 1E of the fifth modification and the girdle of the present embodiment is that the girdle 1E has a pair of first tightening parts 20E, 30E and a pair of second tightening parts 30E, 30E in place of the pair of first tightening parts 20, 20 and the pair of second tightening parts 30, 30 of the girdle 1 and further has a pair of main body upper tightening parts 21E, 21E and third tightening parts 40, 40. Each of the main body upper tightening parts 21E, 21E extends from an upper end part of each of the first tightening parts 20E, 20E, similar to the first tightening parts 20, 20, to the side along a main body upper end E. In the second tightening part 30E, 30E, the side end part of the second tightening part 30, 30 extends further upward to the side beyond the back of the greater trochanter. A side end part of the main body upper tightening part 21E, 21E and a side end part of the second tightening part 30E, 30E may be coupled to each other by the third tightening part 40, 40 that extends vertically in the form of substantially a circular arc at a section close to the front of the greater trochanter from the back thereof.

[Sixth Modification]

Figure 10:
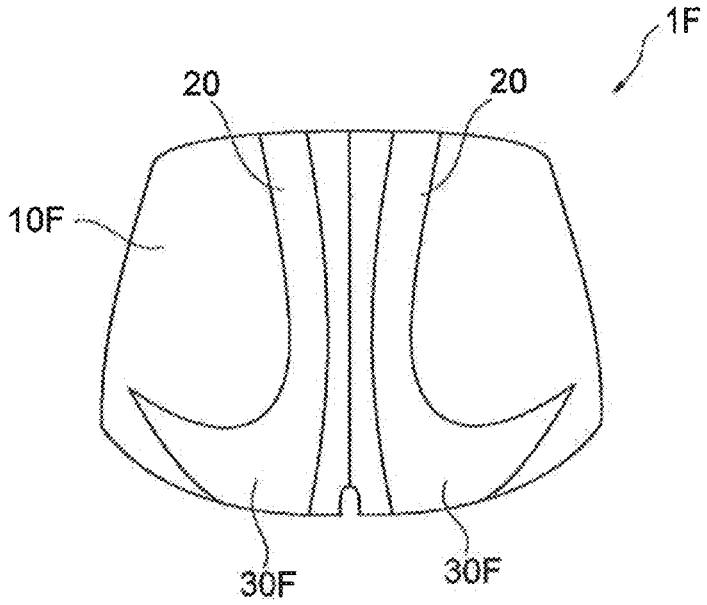
FIG. 10 is a diagram showing the back of a girdle according to a sixth modification of the present invention.

FIG. 10 is a diagram showing the back of a girdle according to a sixth modification of the present invention. The difference in configuration between this girdle 1F of the sixth modification and the girdle of the present embodiment is that the girdle 1F has a main body part 10F and a pair of second tightening parts 30F, 30F in place of the main body part 10 and the pair of second tightening parts 30, 30 of the girdle 1, respectively. The main body part 10F covers only the buttocks of the wearer. For this reason, the second tightening parts 30F, 30F are obtained by eliminating the sections of the femurs covered by the second tightening parts 30, 30. In other words, each of the second tightening parts 30F, 30F is formed so as to cover a section from below the top of the buttock to the upper side of the gluteal fold or to the gluteal fold. Thus, the girdle 1F of the sixth modification may be a short girdle.

[Seventh Modification]

Figure 11:
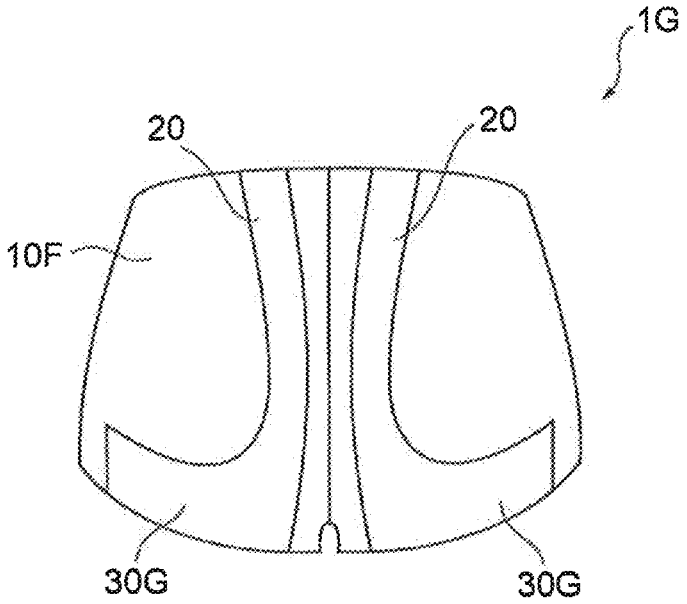
FIG. 11 is a diagram showing the back of a girdle according to a seventh modification of the present invention.

FIG. 11 is a diagram showing the back of a girdle according to a seventh modification of the present invention. The difference in configuration between this girdle 1G of the seventh modification and the girdle of the sixth modification is that the girdle 1G has a pair of second tightening parts 30G, 30G in place of the pair of second tightening parts 30F, 30F of the girdle 1F. As shown in FIG. 11, each of the second tightening parts 30G, 30G may be formed by providing each of the second tightening parts 30F, 30F with a constant width from one end part thereof that is coupled to the first tightening part 20, 20 to the other end part.

In addition, the present invention is not limited to the present embodiment and the present modifications described above, and various modifications can be made. The first tightening parts of the present embodiment and the present modifications extend in a vertical direction. The vertical direction should be construed in a broad sense. In other words, each of the first tightening parts may extend in a direction perpendicular to the waistline or slightly obliquely. Further, the first and second tightening parts of the present embodiment and the present modifications may be formed into straight lines or gentle curves.

In the present embodiment and the present modifications, powernet fabrics are used as the first tightening parts and the second tightening parts; however, the materials of the first tightening parts and the second tightening parts are not limited thereto. For example, satin powernet fabrics, triconet, and the like may be used. Also, in the present embodiment and the present modifications, two-way raschel is used as the main body part; however, the material of the main body part is not limited thereto. For example, spandex cotton jersey or the like may be used as the main body part.

In the present embodiment and the present modifications, the first tightening parts and the second tightening parts are provided on the back of the main body part. However, the first tightening parts and the second tightening parts may be provided on the front of the main body part as well (the outside of the girdle that comes into contact with the skin of the wearer).

The present embodiment and the present modifications have illustrated an example in which the first tightening parts and the second tightening parts are stitched as patches to the main body part. However, the patches of the first tightening parts and the second tightening parts may be configured by a plurality of textiles and may not be stitched but may be attached to the main body part by means of an adhesive or the like. Furthermore, the first tightening parts and the second tightening parts may be formed by changing knitting textures of warp-knitted materials or circular-knitted materials or by opal finish. The first and second tightening parts may also be formed by applying a resin such as polyester or urethane to the main body part (resin treatment).

The present embodiment and modifications have illustrated the short-type girdle and the long-type girdle above the knee, but the characteristics of the present invention can be applied to girdles of various lengths.

The characteristics of the present embodiment and the modifications can be applied not only to girdles (foundations) but also to shorts, pantyhose, leggings, spats, tights, athletic tights, swimsuits, leotards, bodysuits, pants, and other bottom clothes that cover buttocks. When applying the characteristics of the present embodiment and the modifications to outerwear, the bottom clothes of the present embodiment and modifications may be incorporated inside the outerwear.

When the tightening forces of the main body part of the shorts and the like are weak, remarkable effects of the bottom clothes can be obtained by forming the rising angle θ of each second tightening part into an acute angle.

Example 1

An example of the girdle 1 of the embodiment of the present invention shown in FIG. 3 is produced and evaluated as follows.

[Evaluation 1]

Comparative examples that are compared with the present example are main products of the applicant, and the characteristics and specifications thereof are as follows.

First Comparative Example

Same as a nude wearing thong shorts.

Second Comparative Example

A girdle that is mainly for a young person in his/her twenties and thirties and is intended to "lift the hip to obtain small buttocks and long legs." As with Patent Literatures 1 and 2, this girdle is intended to lift the hip of a young person and shape his/her laterally protruding buttocks, unique to young people, into small buttocks, and has tightening parts extending obliquely upward from the crotch part to the sides along the gluteal folds.

Third Comparative Example

A girdle that is mainly for an elderly person over 50 and is intended to achieve both "lifting the hip" and "stabilizing hip joints during exercise." As with Patent Literatures 1 and 2, this girdle has tightening parts extending obliquely upward from the crotch part to the sides along the gluteal folds.

Figure 12:
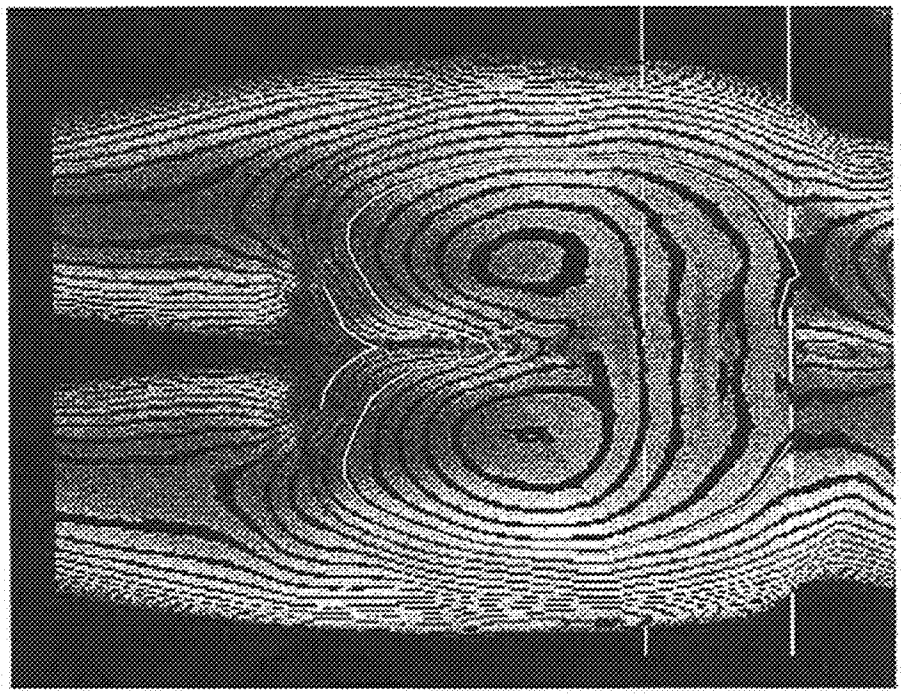
FIG. 12 is a diagram showing a result of a moiré contour analysis performed on the buttocks of an elderly person wearing a first comparative example.
Figure 13:
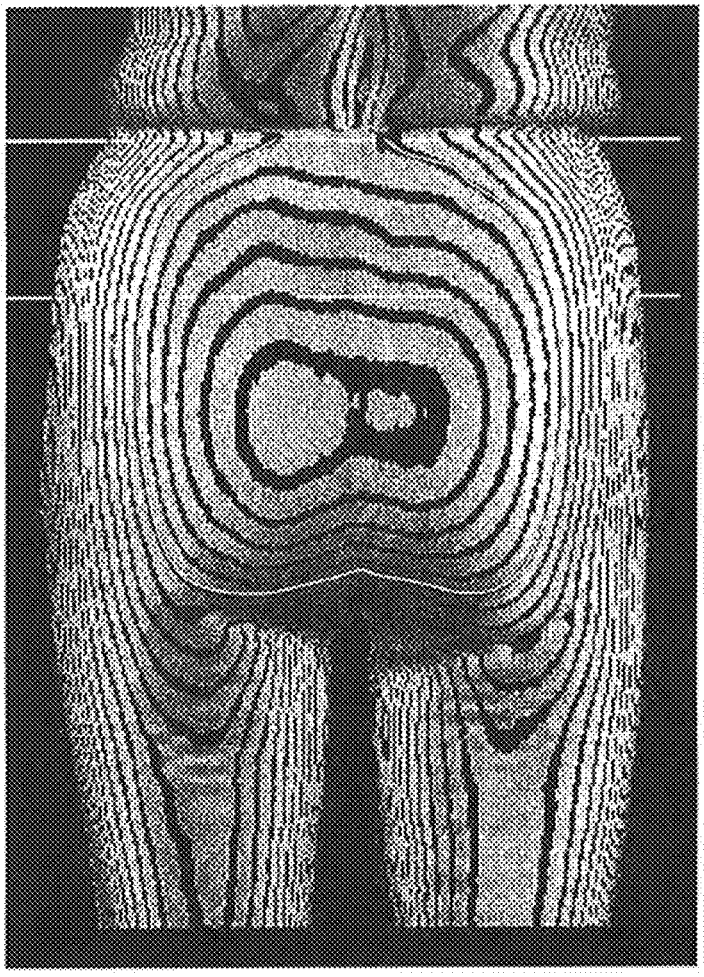
FIG. 13 is a diagram showing a result of a moiré contour analysis performed on the buttocks of the elderly person wearing a second comparative example.
Figure 14:
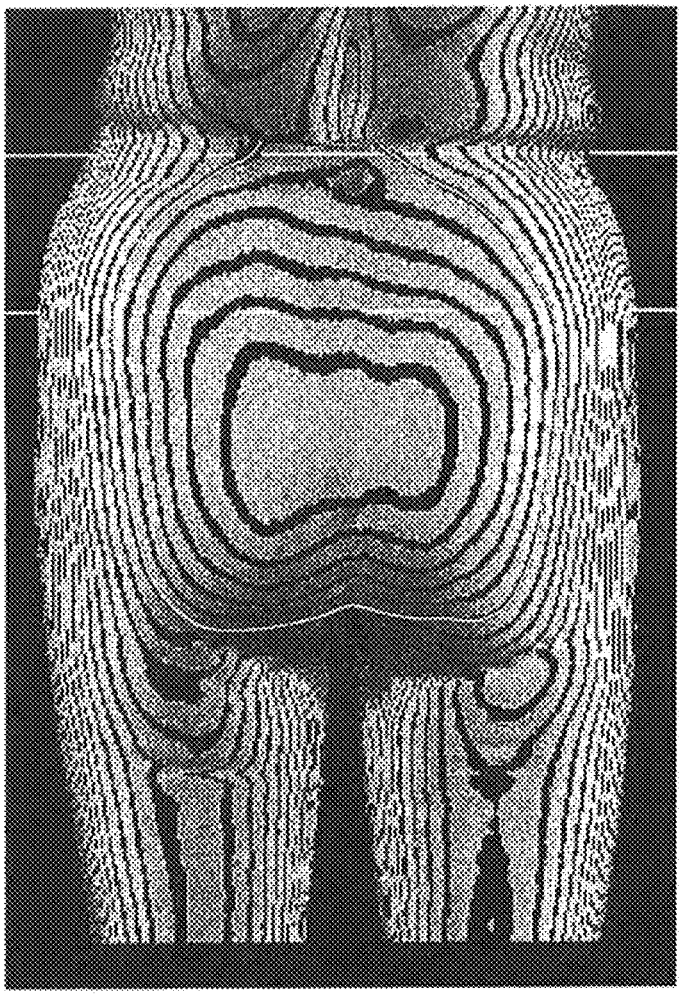
FIG. 14 is a diagram showing a result of a moiré contour analysis performed on the buttocks of the elderly person wearing a third comparative example.
Figure 15:
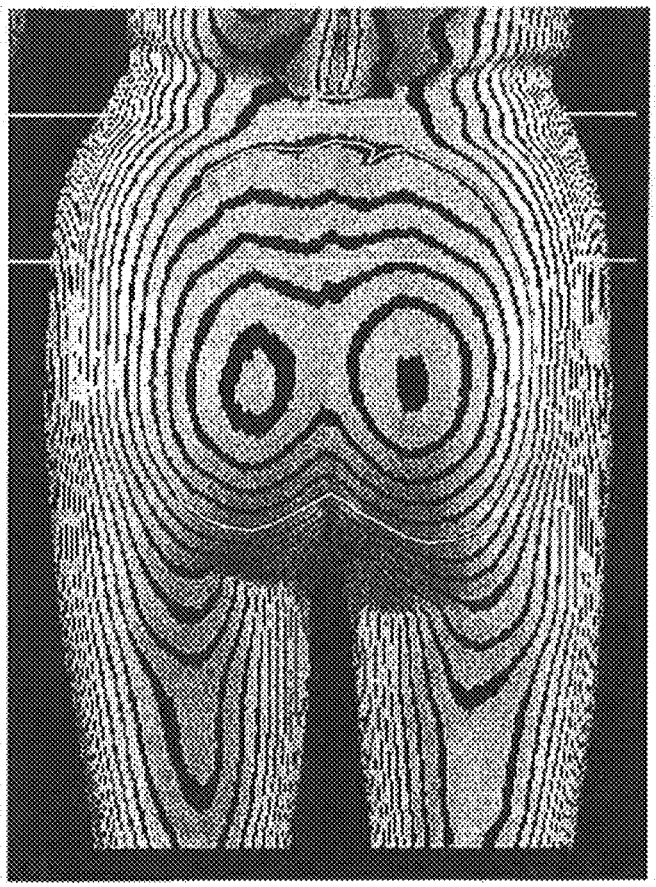
FIG. 15 is a diagram showing a result of a moiré contour analysis performed on the buttocks of the elderly person wearing the girdle of the present embodiment.

In the present evaluation, the buttocks of the elderly person wearing the example and each comparative example of the present invention were photographed and subjected to moiré contour analysis. Results of the analysis are shown in FIGS. 12 to 15. FIG. 12 is a diagram showing a result of the moiré contour analysis performed on the buttocks of the elderly person wearing the first comparative example. FIG. 13 is a diagram showing a result of the moiré contour analysis performed on the buttocks of the elderly person wearing the second comparative example. FIG. 14 is a diagram showing a result of the moiré contour analysis performed on the buttocks of the elderly person wearing the third comparative example. FIG. 15 is a diagram showing a result of a moiré contour analysis performed on the buttocks of the elderly person wearing the girdle 1 of the present example.

As shown in FIG. 12, when the wearer wears the first comparison example, (1) the buttocks sag inward and (2) the flesh near the back of the greater trochanters are sunken. As a result, the entire buttocks form a square shape, and the two left and right mountain shapes are low in height. Further, a plurality of masses of flesh bulge in the femurs under the gluteal folds.

As shown in FIGS. 13 and 14, the tightening parts of the second comparative example and the third comparative example, which extend obliquely upward from the crotch parts to the sides along the gluteal folds, can lift the inward sagging flesh somewhat upward to the sides, and smoothen and reduce the plurality of masses of bulging flesh located on the femurs under the gluteal folds. However, the entire buttocks are shaped into a single mountain, and the square buttocks shape cannot be rounded. Also, the sunken flesh in the vicinity of the back of each greater trochanter cannot be improved.

Figure 2:
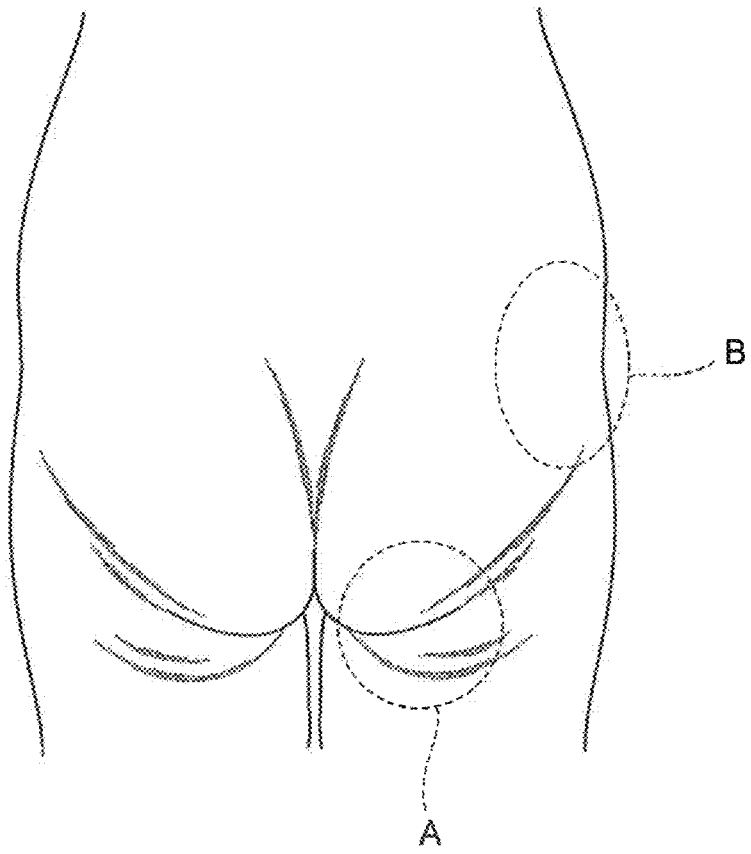
FIG. 2 is a diagram showing buttocks of an elderly person.

As shown in FIG. 15, on the other hand, according to the girdle 1 of the present example, the inward sagging flesh were able to be lifted upward to the top of each buttock and to each side by the upward lifting force of each of the first tightening part 20 and the lifting force of each of the second tightening part 30 that lifts the flesh upward to each side, whereby two left and right mountains can be formed, rounding the entire buttocks. Moreover, the combination of the upward lifting force of each of the first tightening parts 20 and the lifting force of each of the second tightening parts 30 for lifting the flesh upward to each side was able to prevent the flesh on the back of each greater trochanter from being sunken, and the entire buttocks were able to be rounded. In addition, the second tightening parts that cover the sections including the lower sections of the gluteal folds can smoothen and reduce the plurality of masses of flesh bulging in the femurs under the gluteal folds, clearing the middle sections above the gluteal folds. As a result, an ideal, youthful and neat hip such as the one shown in FIG. 2 was able to be formed.

[Evaluation 2]

Comparative examples that are compared with the present example are trial products that are obtained by the applicant by trial and error when inventing the present example. The characteristics and specifications of these comparative examples are as follows.

Fourth Comparative Example

Figure 16:
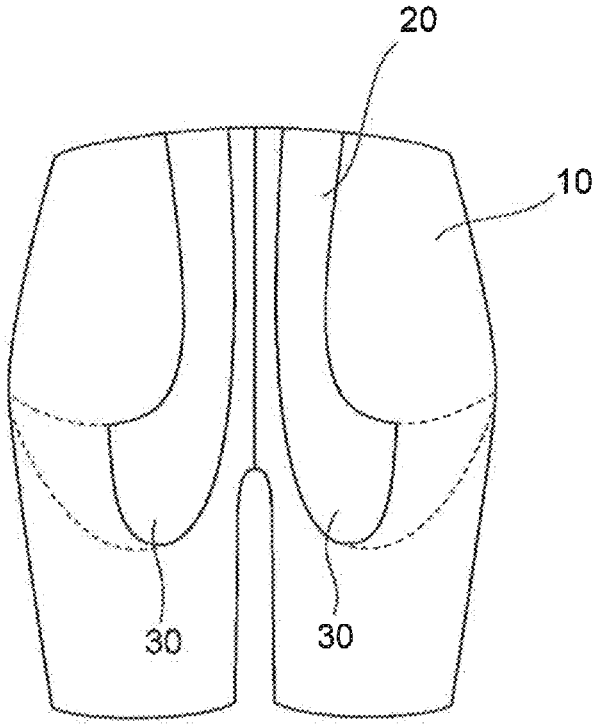
FIG. 16 is a diagram showing a fourth comparative example and a result of a moiré contour analysis performed on the buttocks of an elderly person wearing the fourth example.
Figure 16:
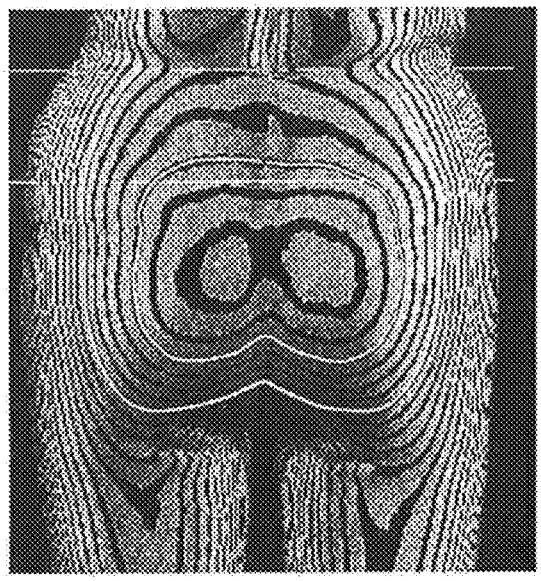

A girdle, in which the side end parts of the second tightening parts 30 of the girdle 1 of the present example do not extend to the vicinity of the lower sections on the back of the greater trochanters and the second tightening parts 30 do not rise high enough, as shown in FIG. 16(*a*).

Fifth Comparative Example

Figure 17:
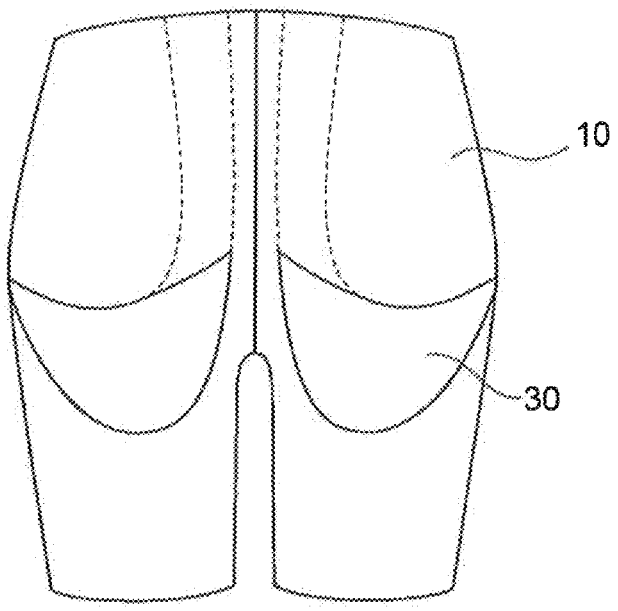
FIG. 17 is a diagram showing a fifth comparative example and a result of a moiré contour analysis performed on the buttocks of an elderly person wearing the fifth example.
Figure 17:
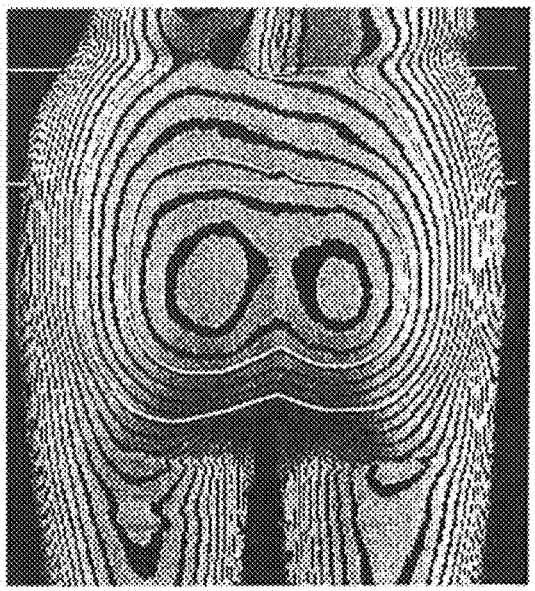

A girdle that does not have the first tightening parts 20 of the girdle 1 of the present example, as shown in FIG. 17(*a*).

In the present evaluation as well, the buttocks of an elderly person wearing the example and each comparative example of the present invention were photographed and subjected to moiré contour analysis. Results of the analysis are shown in FIGS. 16(*b*) and 17(*b*). FIG. 16(*b*) is a diagram showing a result of a moiré contour analysis performed on the buttocks of the elderly person wearing the fourth comparative example. FIG. 17(*b*) is a diagram showing a result of a moiré contour analysis performed on the buttocks of the elderly person wearing the fifth comparative example.

As shown in FIG. 16(*b*), in the fourth comparative example, the functions of the first tightening parts 20 were able to lift the flesh sagging inward in the buttocks. However, due to lack of the functions of the second tightening parts 30, the flesh near the lower sides of the buttocks could not be lifted up sufficiently, and the flesh near the gluteal cleft that were lifted by the first tightening parts 20 could not be moved sufficiently to the tops of the buttocks. As a result, formation of two left and right mountains was inadequate, and the entire buttocks could not be rounded sufficiently. In addition, due to the insufficient functions of the combination of the lifting forces of the first tightening parts 20 and the second tightening parts 30, the sunken flesh on the back of each greater trochanter could not be improved sufficiently. Moreover, a plurality of masses of flesh bulging in the femurs under the gluteal folds could not be smoothened or reduced sufficiently.

As shown in FIG. 17(*b*), in the fifth comparative example, the functions of the second tightening parts 30 were able to lift the entire lower parts of the buttocks, particularly the inward sagging flesh, upward to the sides and somewhat form the section from the lower part of each buttock to the side into a round shape. However, due to lack of the functions of the first tightening parts 20, the section from the gluteal cleft to each top could not be rounded sufficiently, formation of two left and right mountains was inadequate, and the entire buttocks could not be rounded sufficiently. In addition, due to the insufficient functions of the combination of the lifting forces of the first tightening parts 20 and the second tightening parts 30, the sunken flesh on the back of each greater trochanter could not be improved sufficiently. Note that the second tightening parts 30 covering the sections including the lower parts of the gluteal folds were able to smoothen and reduce the plurality of masses of flesh bulging in the femurs under the gluteal folds.

It is, therefore, clear that the operations and effects of the present example described above can be accomplished by the functions of the first tightening parts 20 and the second tightening parts 30.

[Evaluation 3]

Comparative examples that are compared with the present example are trial products that are obtained by the applicant by trial and error when inventing the present example. The characteristics and specifications of these comparative examples are as follows.

Sixth Comparative Example

Figure 18:
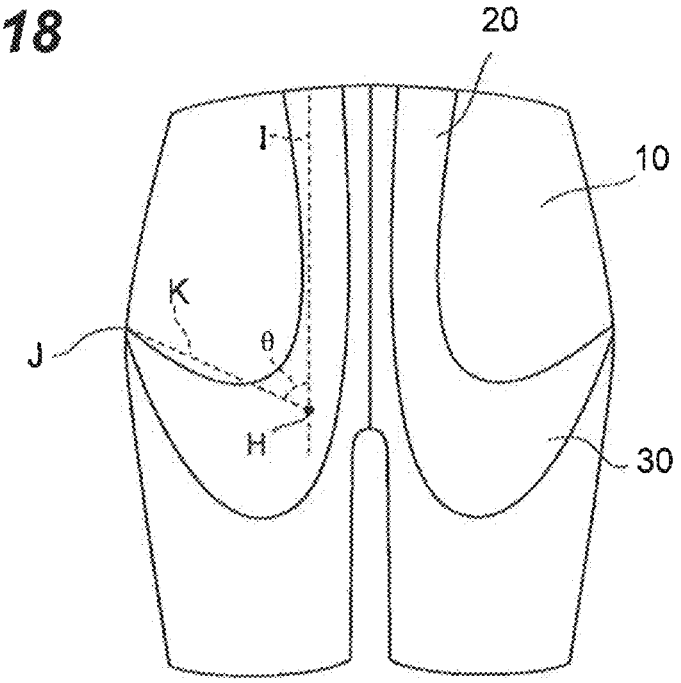
FIG. 18 is a diagram showing a sixth comparative example and a result of a moiré contour analysis performed on the buttocks of an elderly person wearing the sixth example.
Figure 18:
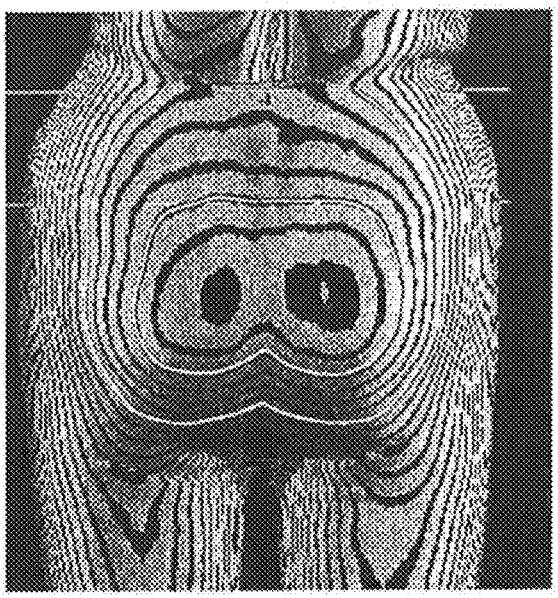

A type of girdle obtained by forming the rising angle of each second tightening part 30 of the present example into a 68 to 50-degree acute angle, as shown in FIG. 18.

Seventh Comparative Example

Figure 19:
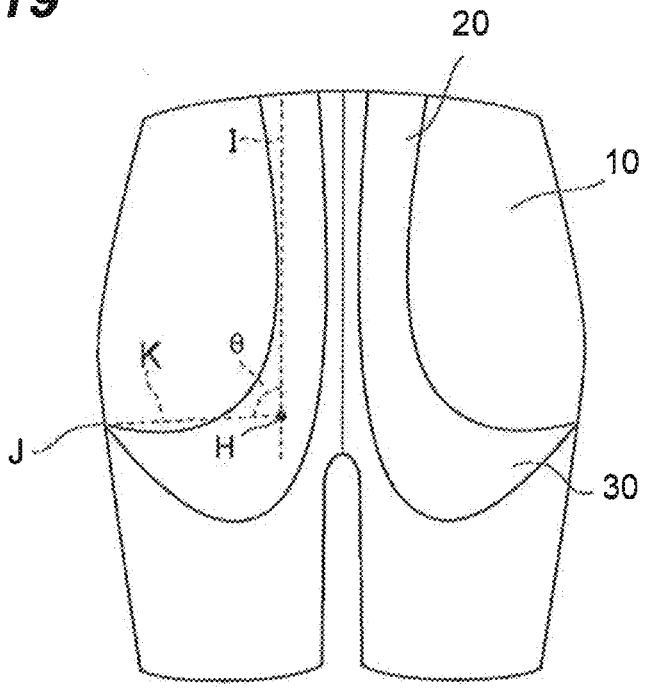
FIG. 19 is a diagram showing a seventh comparative example and a result of a moiré contour analysis performed on the buttocks of an elderly person wearing the seventh example.
Figure 19:
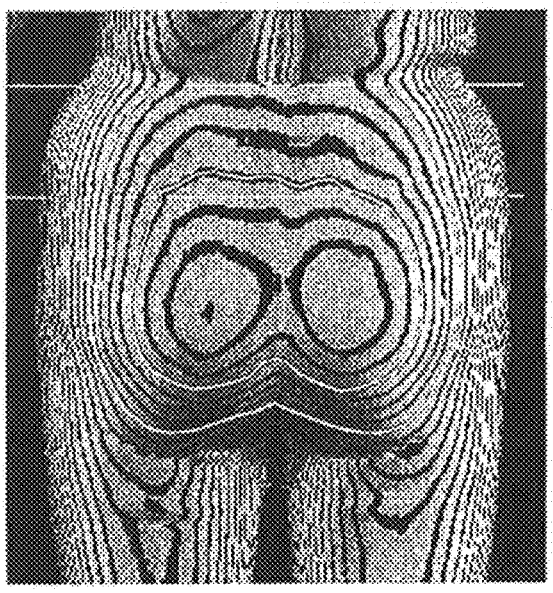

A type of girdle obtained by forming the rising angle of each second tightening part 30 of the present example into a 68 to 90-degree obtuse angle, as shown in FIG. 19.

In the present evaluation as well, the buttocks of an elderly person wearing the example and each comparative example of the present invention were photographed and subjected to moiré contour analysis. Results of the analysis are shown in FIGS. 18(*b*) and 19(*b*). FIG. 18(*b*) is a diagram showing a result of the moiré contour analysis performed on the buttocks of the elderly person wearing the sixth comparative example. FIG. 19(*b*) is a diagram showing a result of the moiré contour analysis performed on the buttocks of the elderly person wearing the seventh comparative example.

As shown in FIG. 18(*b*) and FIG. 19(*b*), the same effects as those of the girdle 1 of the present examples were obtained by the sixth comparative example and the seventh comparative example. Therefore, it is clear that the rising angle θ of each of the second tightening parts 30, 30 is preferably 50 degrees or more to 90 degrees or less with respect to the gluteal cleft.

INDUSTRIAL APPLICABILITY

The present invention can be applied for the purpose of enhancing the buttocks shaping functions for a relatively elderly person.

REFERENCE SIGNS LIST

1, 1A, 1B, 1C, 1D, 1E, 1F, 1G Girdle (bottom clothes)
10, 10B, 10F Main body part
11, 21 Switching part
20, 20C, 20E First tightening part
30, 30A, 30D, 30E, 30F, 30G Second tightening part
31 Lowermost point of lower hem of second tightening part
32 Lowermost point of upper hem of second tightening part
33 End hem near rear center of each of first and second tightening parts
40 Third tightening part

The invention claimed is:

1. Bottom clothes for covering an entire buttocks of a wearer, comprising:

a main body part that covers the buttocks, the main body part having right and left sides and covering each buttock of the wearer, the main body part comprising elastic material and having an extension recoverability; and first tightening bands and second tightening bands both of which are disposed in pairs on left and right sides of the main body part and comprise elastic material and have extension recoverabilities greater than that of the main body part, the first tightening bands each having an upper end and a lower end, the second tightening bands each having a first end and a second end, wherein each of the first tightening bands is disposed on a rear of a buttock from a top of the buttock and extends vertically from a main body upper part to a gluteal fold between the buttocks and a thigh of the wearer, and each of the second tightening bands is disposed below the top of the buttock, the second tightening band having a width providing an expanse covering from below the top of the buttock and at least above the gluteal fold, extending upward from the first end connected to the lower end of the first tightening band, and the second end extends to a point below a back of a greater trochanter.

2. The bottom clothes according to claim 1, wherein each second tightening band is disposed below the top of the buttock and covers at least the gluteal fold.

3. The bottom clothes according to claim 1, wherein a maximum width of each second tightening band is greater than a maximum width of each first tightening band.

4. The bottom clothes according to claim 1, wherein a lowermost point on a lower hem of each second tightening band is located closer to the rear of the buttock than a lowermost point on an upper hem of the second tightening band.

5. The bottom clothes according to claim 1, wherein each second tightening band extends to and covers a portion of the thigh of the wearer below the gluteal fold.

6. The bottom clothes according to claim 1, wherein each first tightening band extends from close to a rear center of the main body upper part.

7. Bottom clothes for covering an entire buttocks of a wearer, comprising:

a main body part that covers the buttocks, the main body part having right and left sides and covering each buttock of the wearer, the main body part comprising elastic material and having an extension recoverability; and first tightening bands and second tightening bands both of which are disposed in pairs on left and right sides of the main body part and comprise elastic material and have extension recoverabilities greater than that of the main body part, the first tightening bands each having an upper end and a lower end, the second tightening bands each having a first end and a second end, wherein each of the first tightening bands is disposed on a rear of a buttock from a top of the buttock and extends vertically from a main body upper part to a gluteal fold between the buttocks and a thigh of the wearer, and each of the second tightening bands is disposed below the top of the buttock, the second tightening band having a width providing an expanse covering from below the top of the buttock and at least above the gluteal fold, extending upward from the first end connected to the lower end of the first tightening band, passes through a point below a back of a greater trochanter and extends forward from the back of the greater trochanter, and the second end further extends upward.

8. The bottom clothes according to claim 7, wherein each wherein each second tightening band is disposed below the top of the buttock and covers at least the gluteal fold.

9. The bottom clothes according to claim 7, wherein a maximum width of each second tightening band is greater than a maximum width of each first tightening band.

10. The bottom clothes according to claim 7, wherein a lowermost point on a lower hem of each second tightening band is located closer to the rear of the buttock than a lowermost point on an upper hem of the second tightening band.

11. The bottom clothes according to claim 7, wherein each second tightening band extends to and covers a portion of the thigh of the wearer below the gluteal fold.

12. The bottom clothes according to claim 7, wherein each first tightening band extends from close to a rear center of the main body upper part.

13. The bottom clothes according to claim 7, further comprising main body upper tightening bands and third tightening bands both of which are disposed in pairs on left and right sides of the main body part, the main body upper tightening bands each having a first end and a second end, wherein each of the main body upper tightening bands extends from the upper end of the first tightening part along the main body upper part, each of the third tightening bands extends vertically in a form of substantially a circular arc at a section close to a front of the back of the greater trochanter, and the second ends of the main body upper tightening bands and the first ends of the second tightening bands are connected by the third tightening bands.

* * * * *